United States Patent [19]

Hicks et al.

[11] Patent Number: 4,916,429

[45] Date of Patent: Apr. 10, 1990

[54] OVERHEIGHT DETECTOR SYSTEM FOR DRIVE THROUGH RESTAURANT

[76] Inventors: Earl G. Hicks, 6518 Azalea Dr., Spring Lake, N.C. 28390; David E. Atkins, 6062 Midus Dr., Hope Mills, N.C. 28348

[21] Appl. No.: 353,954

[22] Filed: May 19, 1989

[51] Int. Cl.[4] ..... G08B 1/04

[52] U.S. Cl. ..... 340/436; 340/942

[58] Field of Search ..... 340/436, 942, 435, 434, 340/943, 933

[56] References Cited

U.S. PATENT DOCUMENTS

| | | | |
|---|---|---|---|
| 3,488,510 | 1/1970 | Raymond, Jr. et al. | 340/942 |
| 3,896,414 | 7/1975 | Rulo | 340/942 |
| 4,284,971 | 8/1981 | Lowry et al. | 340/942 |

*Primary Examiner*—Joseph A. Orsino
*Assistant Examiner*—Frank M. Scutch, III
*Attorney, Agent, or Firm*—Olive & Olive

[57] ABSTRACT

A detector system for detecting overheight vehicles in a drive through restaurant is employed to prevent damage to an overhanging roof or canopy by signalling both the vehicle driver and a restaurant attendant simultaneously when an overheight vehicle is detected prior to reaching the overhanging roof or canopy.

10 Claims, 3 Drawing Sheets

OVERHEIGHT DETECTOR SYSTEM FOR DRIVE THROUGH RESTAURANT

FIELD OF INVENTION

The present invention relates to a detector system for detecting overheight vehicles in a drive through restaurant to prevent damage to the roof overhang or the like in the path of travel.

BACKGROUND ART

The typical drive through or so called fast food restaurant has an order station at which the customer sees a priced menu and places an order, a pay station at which the customer pays for the order and a pick up station at which the customer picks up the ordered items of food. The pick up and pay station may constitute the same station.

In order to provide weather protection, it has been a customary practice in the drive through restaurant trade to construct the restaurant building with a rood overhang or canopy at the pay station and also at the pick up station if at a different location. The roof overhang provides protection for both the vehicle operator and the restaurant attendant when exchanging money at the pay station or when delivering food items at the pick up station. Since the typical drive through restaurant deals with a wide range of vehicles, a very critical problem in the industry is that of dealing with damage to the roof overhang or canopy when an overheight vehicle drives through the upper part of the vehicle hits the roof overhang or canopy at the pay or pick up station. However, the typical flexible vehicle radio antennas, even though overheight, can normally be accommodated without damage to the roof overhang or canopy.

Both lighted and unlighted horizontal, pivotal and cushioned arms have been mounted on poles at a location before the pay and/or pick up station and at a height intended to hit any overheight portion of a vehicle as a warning to the driver. However, the driver often does not observe or hear the arm striking the vehicle and damage to the roof overhang or canopy follows as the vehicle drives through. Also, warning arms of this type become defective through use by reason of rust, corrosion or deterioration of the parts. The vehicle may be damaged by the arm itself failing to operate as required. Such warning arrangements also lack the ability to discriminate between non-damaging vehicle antennas and overheight vehicles which do cause damage.

The object of the invention thus becomes that of providing an improved overheight detector system for a drive through restaurant which overcomes the foregoing disadvantages. Other objects will become apparent as the description proceeds.

SUMMARY OF INVENTION

An overheight detector system for a drive through restaurant uses an optical sensor at an appropriate level and located so as to detect overheight vehicles before the vehicles reach the location of any roof overhang or canopy typically at a pay station or pick up station. A time delay enables the sensor to discriminate between a typically non-damaging antenna and an overheight vehicle likely to cause damage. The detector, once activated by an overheight vehicle, causes either or both visible and audible signals to warn both the driver of the vehicle at the order station and the attendant at the pick up and/or pay station of the fact that the vehicle is overheight. Thus, both the driver of the vehicle and the attendant are alerted to warning the vehicle driver to avoid the roof overhang and thereby prevent the type of damage which has been experienced throughout the industry. However, if the vehicle itself is not overheight but does have an overheight non-damaging antenna, the detector system senses this and allows the vehicle to pass without activating the warnings.

DESCRIPTION OF THE PREFERRED EMBODIMENT

Drive through restaurants, as previously mentioned, have various driveway, order, pay and pick up station arrangements. While the order may be placed at a driveway location where there is no roof overhang or canopy, the typical drive through arrangement directs the vehicle beneath a roof or canopy overhang over a pay station, a pick up station or a combined pick up and pay station where a roof overhang or canopy is desirable for weather protection of both the driver of the vehicle and the restaurant attendant involved in cash transaction or food delivery.

Figure 1:
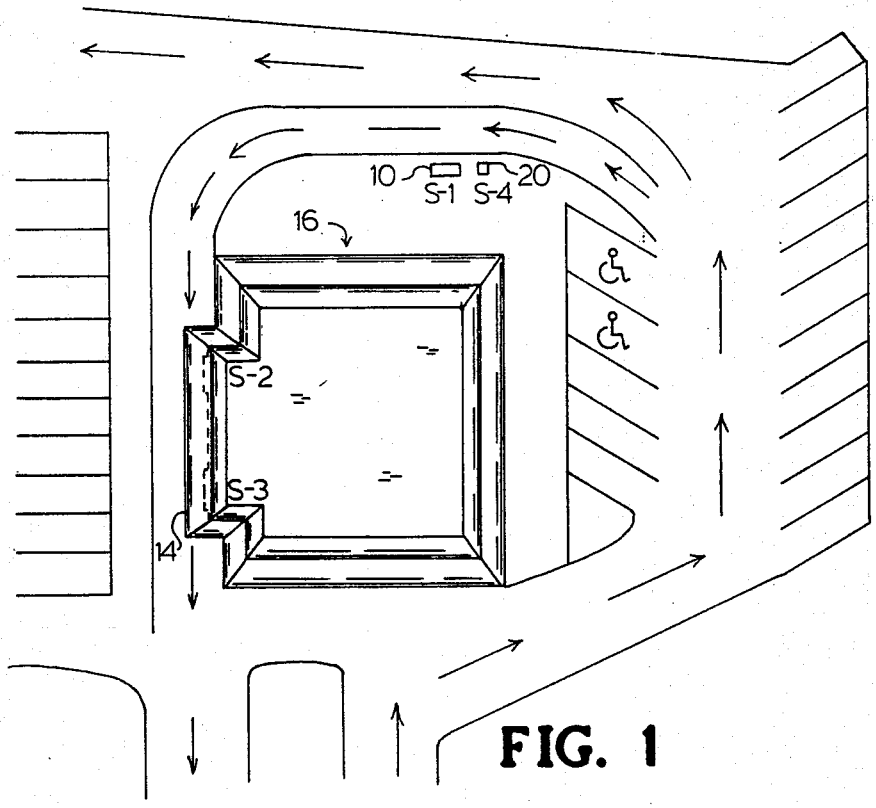
FIG. 1 is a somewhat schematic view of the layout of a typical drive through or so called fast food restaurant with an overheight detector system added according to the invention.

In the embodiment used for illustration, the order is placed at a first station S-1 (FIG. 1) having a menu board (not shown) and a conventional combination microphone-speaker 10. The order is paid for at a second station S-2 and the food is picked up a third station S-3 (FIG. 1). In reaching station S-3 the vehicle 12 is forced to travel beneath a roof overhang or canopy 14 forming part of the restaurant building 16. In the illustrated embodiment, the overheight detector 20 of the invention is placed at a fourth station S-4 which requires the incoming vehicle 12 to go past height detector 20 before reaching the station S-3. In some installations it should be understood that the pay station S-2 and pick up station S-3 may constitute the same station.

Overheight detector 20 comprises a hollow post 22 illustrated as a hollow post of square cross section within which is mounted a support bracket 24 for receiving an optical sensor assembly 40 confined in a housing 26 secured by screws 27. Post 22 provides an aperture 28 through which the optical sensing is performed. A mating gasket 30 provides a weatherproof seal and a mating aperture 32. Access is obtained through an access door 34 secured by screws 36 against a weatherproofing gasket 38. While not shown, it will of course be understood that housing 26 has an aperture mating the optical sensor and apertures 28, 32 in the post 22 and gasket 30.

Figure 4:
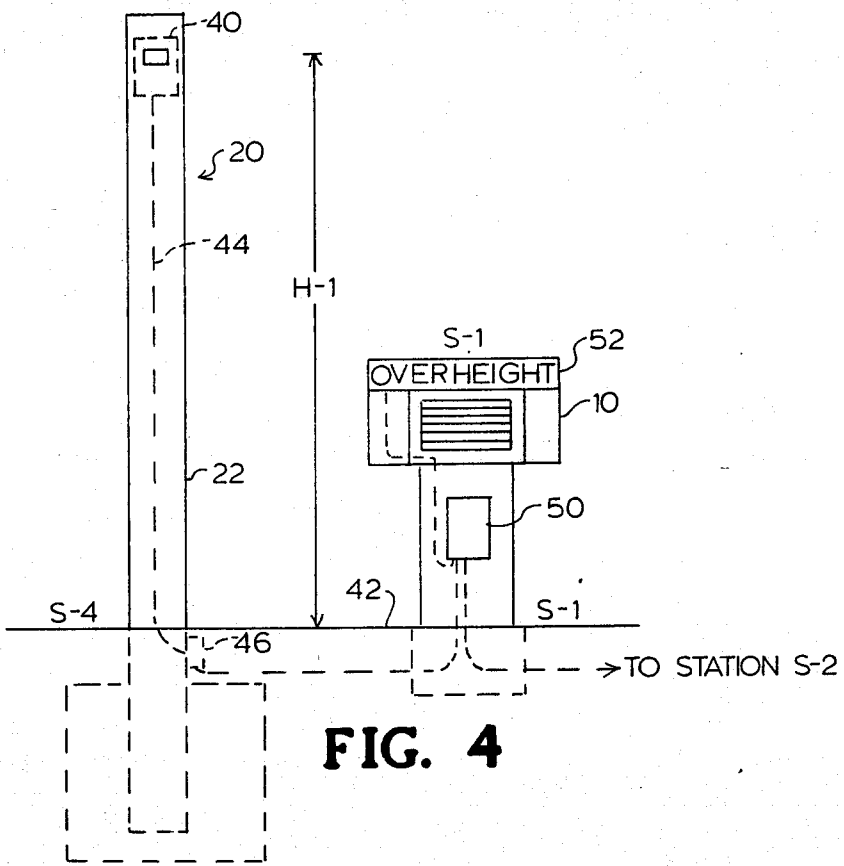
FIG. 4 is a schematic illustration of the overheight detector post and order station warning arrangement according to the invention.
Figure 5:
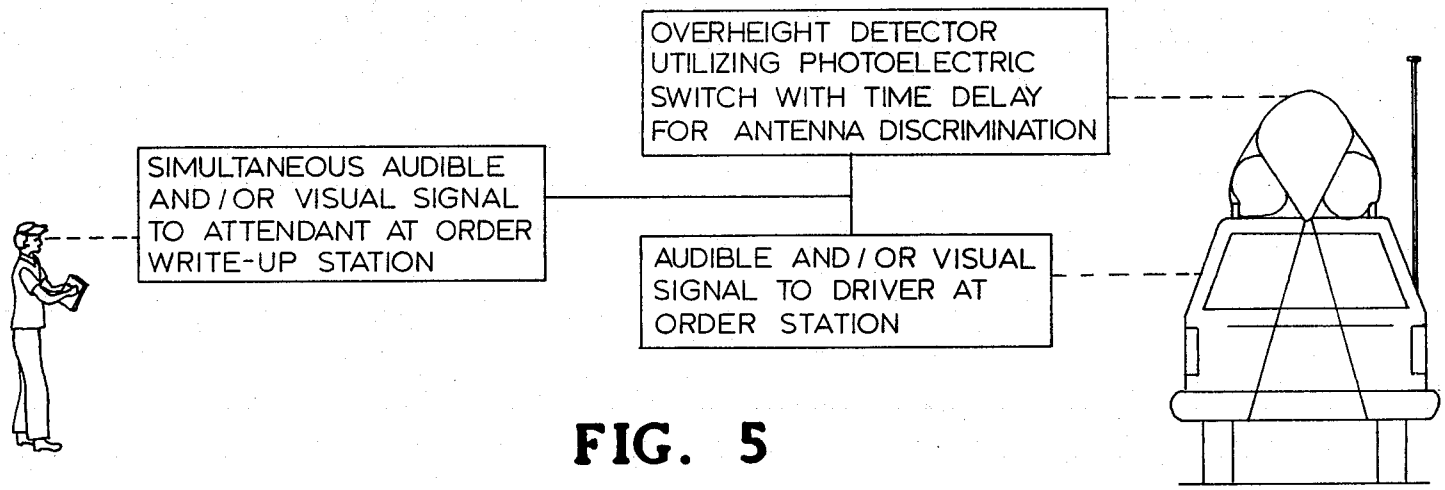
FIG. 5 is a schematic wiring diagram for an overheight detector system according to the invention.

A commercially available Class 9006, type PE 2, heavy duty, long range photoelectric switch equipped with a short adjustable time delay e.g. 4 seconds, may by the Square D Company of Palatine, Ill. has been successfully employed as the sensor assembly 40. The height H-1 above the drive surface 42 (FIG. 4) is selected to discriminate between vehicles of a height less than the height H-2 of the overhang or canopy 14 above the drive surface 42. Also, as previously mentioned by using a time delayed sensor, vehicles which themselves are not overheight but which have a non-damaging antenna are allowed to pass without triggering the warning devices.

The low voltage conduit 44, typically a five wire conduit, is fed through post 22 (FIG. 4) to a junction box 46 then underground to a warning bell 50 and visual warning sign 52 on post 54 at the order station S-1. Simultaneously, the same signal is transmitted to station S-2 where the order is being written where another warning bell and visual sign (not shown) similar to bell 50 and sign 52 are activated to signal the attendant to take immediate action to prevent damage to the overhanging roof or canopy 14 in the anticipated line of travel.

Figure 2:
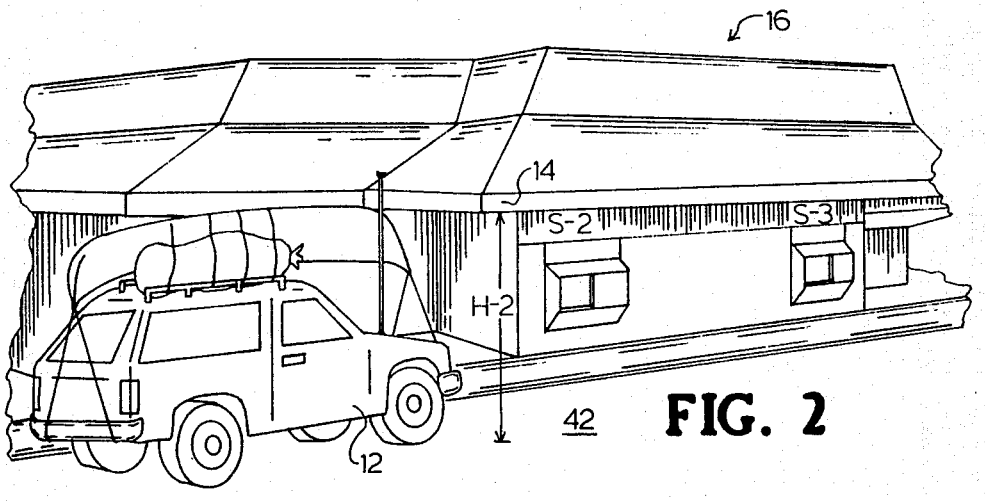
FIG. 2 is a perspective of a portion of a drive through restaurant showing a roof overhang over a pay station with an overheight vehicle approaching the overhang and likely to cause damage.
Figure 3:
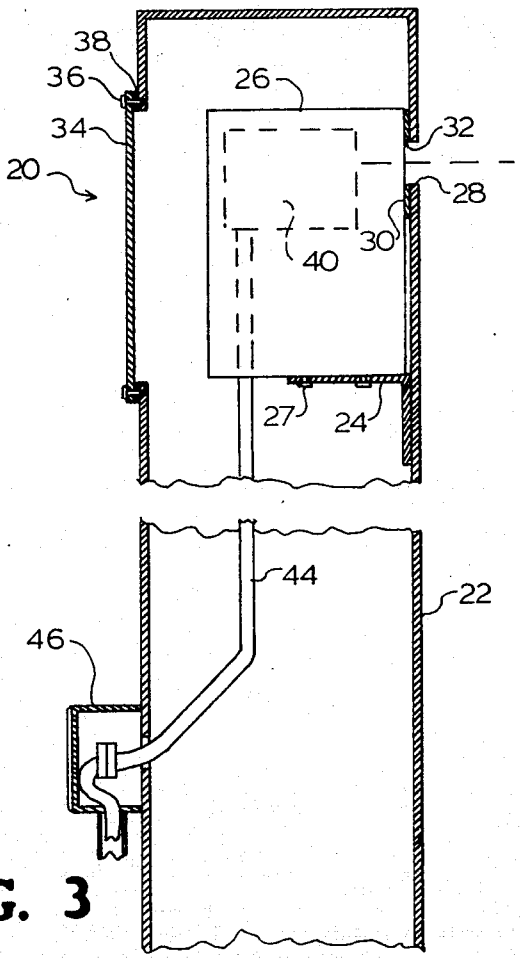
FIG. 3 is a sectional view of a post and optical sensor construction according to the invention.

While an exceptionally high and typically flexible radio antenna on the vehicle 12 might signal an overheight condition such antennae typically does not lead to damage to the roof or canopy overhang 14. Therefore as previously mentioned the detection system of the invention incorporates a short timing delay to prevent activation of the warning bells and signs unless the overheight condition persists for some predetermined time indicative of an overheight vehicle body or overheight roof load (FIG. 2) or the like.

It will be understood that any suitable warning device may be employed and either audible or visual signals or both may be used to warn both the driver and attendant.

What can be seen from the foregoing are the following advantages:

(1) The invention system is not subject to mechanical failure of arms or the like.

(2) No physical contact with the vehicle is required.

(3) Dual protection is provided in that both the driver of the vehicle and the order attendant are warned simultaneously of the potential hazard to the building.

(4) Transient passage of overheight antennas on an otherwise non-overheight vehicle are accommodated.

(5) An essentially all-weather overheight detection system is provided.

While the invention has been described in a preferred embodiment, it will be understood that numerous changes embodying the invention may be made by those skilled in the art and therefore the invention has been described by way of illustration rather than limitation.

What is claimed is:

1. A vehicular overheight detection and warning system for a building having a roof or canopy overhang with a fixed clearance above a driveway surface along which a vehicle is required to drive to obtain services from an attendant at a service location available to the driver of the vehicle and within the building is protected by the overhang, comprising:

(a) a detector mounted at a detection location required to be passed by the vehicle before reaching the service location and at an elevated level selected so as to be able to detect any vehicle of a height in excess of said clearance and to actuate an associated switch in response thereto;

(b) first signalling means dependent on actuation of said switch and operative to produce a first selected signal perceptible by the driver of the vehicle at a location prior to reaching the said service location to warn the driver of an overheight condition when so detected;

(c) second signalling means dependent on actuation of said switch and operative to produce a second selected signal at said service location perceptible to said attendant to simultaneously warn said attendant of said overheight vehicle; and (d) means for delaying the actuation of said switch to discriminate between overheight vehicles and overheight vehicle antennas.

2. A vehicular overheight detection and warning system as claimed in claim 1, wherein said building comprises a drive through restaurant building and said service location comprises a pay or food delivery location or both.

3. A vehicular overheight detection and warning system as claimed in claim 1, wherein said detector includes said means for delaying the actuation of said switch to discriminate between overheight vehicles and overheight vehicle antennas.

4. A vehicular overheight detection and warning system as claimed in claim 1, wherein said signals are visual.

5. A vehicular overheight detection and warning system as claimed in claim 1, wherein said signals are both audible and visual.

6. A vehicular overheight detection and warning system as claimed in claim 2, wherein said detector includes said means for delaying the actuation of said switch to discriminate between overheight vehicles and overheight vehicle antennas.

7. A vehicular overheight detection and warning system as claimed in claim 2, wherein said signals are visual.

8. A vehicular overheight detection and warning system as claimed in claim 2, wherein said signals are both audible and visual.

9. A vehicular overheight detection and warning system as claimed in claim 1 wherein, said detector comprises a photoelectric detector.

10. A vehicular overheight detection and warning system as claimed in claim 2, wherein said signals are audible.

* * * * *

UNITED STATES PATENT AND TRADEMARK OFFICE

CERTIFICATE OF CORRECTION

PATENT NO. : 4,916,429

DATED : April 10, 1990

INVENTOR(S) : Earl G. Hicks, David E. Atkins

It is certified that error appears in the above-identified patent and that said Letters Patent is hereby corrected as shown below:

Column 1, line 21, correct "rood" to read --roof--.

Column 3, line 5, correct "may" to read --made--.

Column 3, line 30, correct "antennae" to read --antenna--.

Signed and Sealed this

Second Day of July, 1991

*Attest:*

HARRY F. MANBECK, JR.

*Attesting Officer*

*Commissioner of Patents and Trademarks*